United States Patent [19]

Russell

[11] 4,174,620

[45] Nov. 20, 1979

[54] JEWELRY WITH ADHESIVE INSERT FOR LIFTING OBJECTS

[76] Inventor: David E. Russell, 110 Riverside Ave., Jacksonville, Fla. 32202

[21] Appl. No.: 812,518

[22] Filed: Jul. 5, 1977

[51] Int. Cl.[2] ..... A44C 9/00; B65G 7/12

[52] U.S. Cl. ..... 63/1 R; 63/DIG. 1; 63/29 M; 294/25

[58] Field of Search ..... 63/1 R, DIG. 1, 29 M; 294/25; 2/21; 224/28 F

[56] References Cited

U.S. PATENT DOCUMENTS

| | | | |
|---|---|---|---|
| 681,054 | 8/1901 | Hawley | 294/25 |
| 888,976 | 5/1908 | Duperrault | 294/25 |
| 2,176,052 | 10/1939 | Beyer | 63/29 M |
| 2,600,647 | 6/1952 | Hauser | 294/25 |
| 2,610,882 | 9/1952 | Sutliffe | 294/25 X |
| 3,263,444 | 8/1966 | DiCroce | 63/29 M |

FOREIGN PATENT DOCUMENTS

| | | | |
|---|---|---|---|
| 649678 | 1/1951 | United Kingdom | 63/29 M |

*Primary Examiner*—F. Barry Shay

*Attorney, Agent, or Firm*—George H. Baldwin; Arthur G. Yeager

[57] ABSTRACT

A small adhesive plastic insert and/or a magnetic insert, mounted in an arm bracelet, a finger ring, a wrist watch or other arm ornament and shaped to conform to the appearance of the bracelet, ring, watch or ornament, permits the wearer of the bracelet, watch or ornament to pick up small objects on flat surfaces without difficulty. The insert is shaped and colored to harmonize with the appearance of the bracelet, ring, watch or ornament. The insert is removably held, for example by a force fit, and may be replaced when dirty.

3 Claims, 2 Drawing Figures

JEWELRY WITH ADHESIVE INSERT FOR LIFTING OBJECTS

BACKGROUND OF THE INVENTION

1. Field of Invention

The present invention relates to arm bracelets, finger rings, wrist watches or other arm ornaments and more particularly to an accessory adhesive plastic or magnetic insert mounted in or on said bracelets, rings, watches or ornaments.

2. Description of the Prior Art

Combinations of bracelets, finger rings, wrist watches and arm ornaments with other accessories such as hidden compartments and poisoned needles are known. This useful design and assembly is not known to exist.

SUMMARY OF THE INVENTION

Everyday, people experience difficulty in picking up small objects such as coupons, restaurant checks and coins from smooth, flat surfaces. This is sometimes embarassing to the person involved. The principal object of this invention is to provide a ready means of slightly lifting such objects, so that the fingers can be readily inserted under the object. An adhesive can be used to contact and lift practically all small, light objects and a magnet will give greater lift when used on objects subject to magnetic force. The adhesive and/or magnet is adfixed to an arm bracelet, a finger ring, a wrist watch or other arm ornament and is always present when needed.

Another principal object of this invention is to provide an accessory lifting device which will blend into the design and appearance of the arm bracelet, finger ring, wrist watch or other arm ornament. The term "wrist watch", as used herein, is understood to include the wrist band connected to the watch.

Another object of this invention is to provide an accessory which, in addition to being used with newly manufactured, arm-worn objects, can be added to existing hand-worn objects.

Still another object of the present invention is to provide an accessory which, because of its simplicity, can be economically produced by conventional mass production methods and can be easily handled, packaged, stored and distributed.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

The drawings are illustrations only, and changes may be made in the specific constructions illustrated and described, so long as the scope of the appended claims is not voided.

DESCRIPTION OF THE PREFERRED EMBODIMENTS

Figure 1:
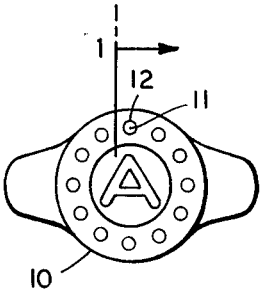
FIG. 1, is a plan view of a finger ring showing an enlargement of the present invention inserted within the finger ring.
Figure 2:
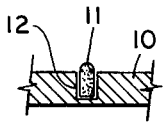
FIG. 2, is an enlarged sectional view taken substantially on section line 1 of FIG. 1.

Referring to the drawings, 10 is a finger worn ring. In FIGS. 1 and 2 of the drawings, like reference characters denote like parts. 11 is a firm but pliable plastic material having adhesive characteristics ("rubber-like" but "sticky"), and can be constructed from any sutiable material. 12 is a hole drilled or cast into 10 so as to receive 11. 11 if force fitted into 12. In operation, the person wearing 10 simply touches the small object to be picked up with 11. When 11 wears down or becomes dirty, it can be removed with tweezers or a sharp pin, and a new replacement can be forced into place with a toothpick or similar object. In lieu of the hole and pressure fit arrangement shown, a sliding dovetail or any other means of securing 11 to 10 may be employed. 11 may be shaped and colored to harmonize with the design and appearance of 10. Another good location for the small plastic and adhesive insert is in a segment of the wrist band of a wrist watch on the opposite side of the wrist from the watch. An optional magnetic insert similar to 11, but used to supplement the action of 11 may be employed. 11 can also be constructed so as to contain a magnetic powder or filler, thus increasing the effectiveness of a single adhesive insert.

While the invention has been described with respect to certain specific embodiments, it will be appreciated that many modifications and changes may be made by those skilled in the art without departing from the spirit of the invention. It is intended, therefore, by the appended claim to cover all such modifications and changes as fall within the true spirit and scope of the invention.

What is claimed as new and what it is desired to secure by Letters Patent of the United States is:

1. An article of personal jewelry having a size and shape adapting it for attachment to a portion of a wearer's body at an area near a free end of an arm, said article having an outer surface facing generally away from a wearer's body area, contacting means supported by and protruding outwardly away from said surface and facing away from a wearer's body area for contacting and lifting small, light objects, said contacting means comprising a plastic element with a sticky exterior surface positioned to readily contact such objects, and mounting means for firmly and removably securing said element to said article whereby said element may be readily replaced when said element is substantially incapable of lifting small, light objects, said surface including an ornamental design, said contacting means being adapted and arranged to harmonize with said design thereby rendering same unobtrusive.

2. An article of personal jewelry having a size and shape adapting it for attachment to a portion of a wearer's body at an area near a free end of an arm, said article having an outer surface facing generally away from a wearer's body area, contacting means supported by and protruding outwardly away from said surface and facing away from a wearer's body area for contacting and lifting small, light objects, said contacting means comprising a plastic element with a sticky exterior surface positioned to readily contact such objects, and mounting means for firmly and removably securing said element to said article whereby said element may be readily replaced when said element is substantially incapable of lifting small, light objects, said element including magnetic means for aiding the lifting of light objects attractable by said magnetic means.

3. The article as defined in claim 2 wherein said surface includes an ornamental design, said contacting means being adatped and arranged to harmonize with said design thereby rendering same unobtrusive.

* * * * *